US006267631B1

(12) United States Patent
Anderson

(10) Patent No.: US 6,267,631 B1
(45) Date of Patent: Jul. 31, 2001

(54) BICYCLE WATERCRAFT ACCESSORY

(76) Inventor: Marvin L. Anderson, 410 Pierce St., Apt. 803, Sioux City, IA (US) 51101

( * ) Notice: Subject to any disclaimer, the term of this patent is extended or adjusted under 35 U.S.C. 154(b) by 0 days.

(21) Appl. No.: 09/342,497

(22) Filed: Jun. 29, 1999

(51) Int. Cl.[7] ..... B63H 21/175
(52) U.S. Cl. ..... 440/12; 440/27; 440/30
(58) Field of Search ..... 440/11, 12, 28–31, 440/26, 27; 114/352, 354

(56) References Cited

U.S. PATENT DOCUMENTS 547,422 * 10/1895 Dean ..... 440/21
5,522,741 * 6/1996 Yun ..... 440/29

* cited by examiner

*Primary Examiner*—Ed Swinehart
(74) *Attorney, Agent, or Firm*—Ellis Venable & Busam, LLP

(57) ABSTRACT

Disclosed is a bicycle accessory generally comprised of at least one pontoon, a frame, front bicycle mounting hardware and rear bicycle mounting hardware, and a propulsion mechanism. A common bicycle is mounted on the front bicycle and rear bicycle mounting hardware and the combination placed on water deep enough to enable floatation of the watercraft, a bicycle and a rider thereupon. A rider climbs propels and directs the watercraft in the manner customary for bicycles on land.

8 Claims, 6 Drawing Sheets

BICYCLE WATERCRAFT ACCESSORY

FIELD OF THE INVENTION

The present invention relates to the field of pedal propelled watercraft More particularly, the present invention relates to the field of bicycle accessories that enable the use of bicycle as a watercraft.

BACKGROUND

Boating is a popular activity for a substantial segment of our population. Various boating styles account for the many alternate forms of watercraft. One form is the common pedal powered watercraft In most previous designs of common pedal powered watercraft, the pedals are generally designed as an integral to the watercraft structure. Such designs are a common sight on small lakes and are generally used for recreational sightseeing or exercising.

Bicycling is also popular worldwide both for practical and recreational uses but is limited to land activity. If one wanted to both bike and boat, he or she would have to either opt for either a bicycle or a boat to do so. Accordingly, a pontoon watercraft that can accessorize a common bicycle for use on water would be useful for exercising or recreation.

SUMMARY OF THE INVENTION

It is an object of the present invention to provide a watercraft that can accessorize a common bicycle. More specifically, a watercraft that is attachably removable to a common bicycle, and that is propelled by the customary pedaling that ordinarily propels a bicycle on substantially solid surfaces, and that is steered in the same way that an ordinary bicycle is. It is a further object of this invention to provide a lightweight pontoon watercraft that provides minimal resistance to water and is difficult to capsize.

BRIEF DESCRIPTION OF THE DRAWINGS

The novel features that are considered characteristic of the invention are set forth with particularity in the appended claims. The invention itself, however, both as to its structure and its operation together with the additional object and advantages thereof will best be understood from the following description of the preferred embodiment of the present invention when read in conjunction with the accompanying drawings wherein:

DESCRIPTION OF PREFERRED EMBODIMENTS

The novel features that are considered characteristic of the invention are set forth with particularity in the appended claims. The invention itself, however, both as to its structure and its operation together with the additional object and advantages thereof will best be understood from the following description of the preferred embodiment of the present invention when read in conjunction with the accompanying drawings. Unless specifically noted, it is intended that the words and phrases in the specification and claims be given the ordinary and accustomed meaning to those of ordinary skill in the applicable art or arts. If any other meaning is intended, the specification will specifically state that a special meaning is being applied to a word or phrase. Likewise, the use of the words "function" or "means" in the Description of Preferred Embodiments is not intended to indicate a desire to invoke the special provision of 35 U.S.C. §112, paragraph 6 to define the invention. To the contrary, if the provisions of 35 U.S.C. §112, paragraph 6, are sought to be invoked to define the invention(s), the claims will specifically state the phrases "means for" or "step for" and a function, without also reciting in such phrases any structure, material, or act in support of the function. Even when the claims recite a "means for" or "step for" performing a function, if they also recite any structure, material or acts in support of that means of step, then the intention is not to invoke the provisions of 35 U.S.C. §112, paragraph 6. Moreover, even if the provisions of 35 U.S.C. §112, paragraph 6, are invoked to define the inventions, it is intended that the inventions not be limited only to the specific structure, material or acts that are described in the preferred embodiments, but in addition, include any and all structures, materials or acts that perform the claimed function, along with any and all known or later-developed equivalent structures, materials or acts for performing the claimed function.

Figure 1:
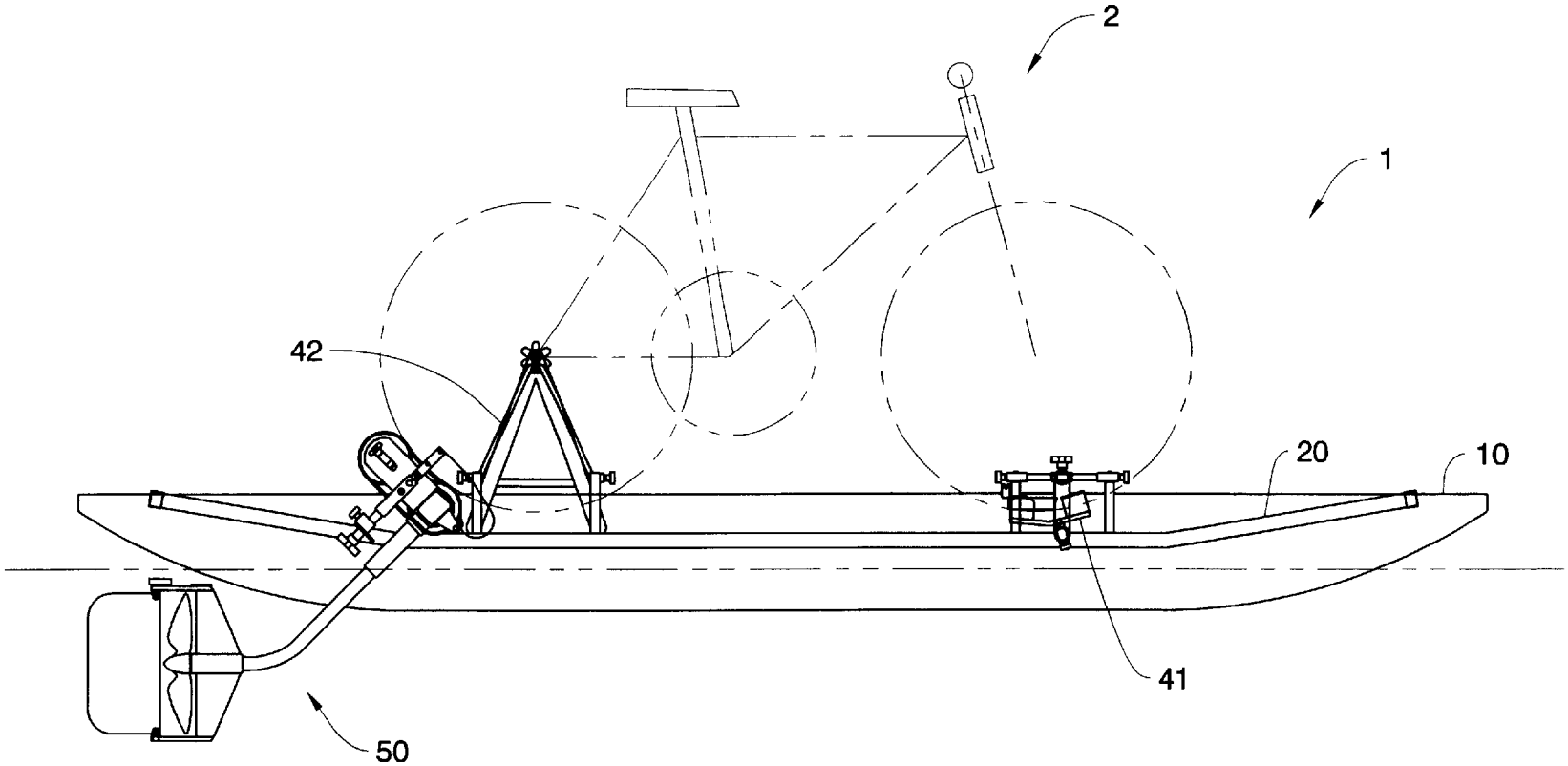
FIG. 1 depicts a side view of the present invention.

The present invention, a bicycle powered watercraft 1, is useful to accessorize a common bicycle for use on water. The watercraft 1 is generally comprised of at least one pontoon 10, a flame 20, front and rear mounting hardware 41 and 42 respectively, and a propulsion mechanism 50. In use, a common bicycle 2 is mounted on the bicycle mounting hardware, 41 and 42, and the combination placed on water deep enough to enable floatation of the combination and to avoid contact of the propulsion mechanism 50 with the lake bed or other hard objects in the body of water. Thereafter a rider climbs aboard the bicycle 2 and watercraft 1 and pedals and steers in the customary fashion for bicycles. See FIG. 1.

Figure 2:
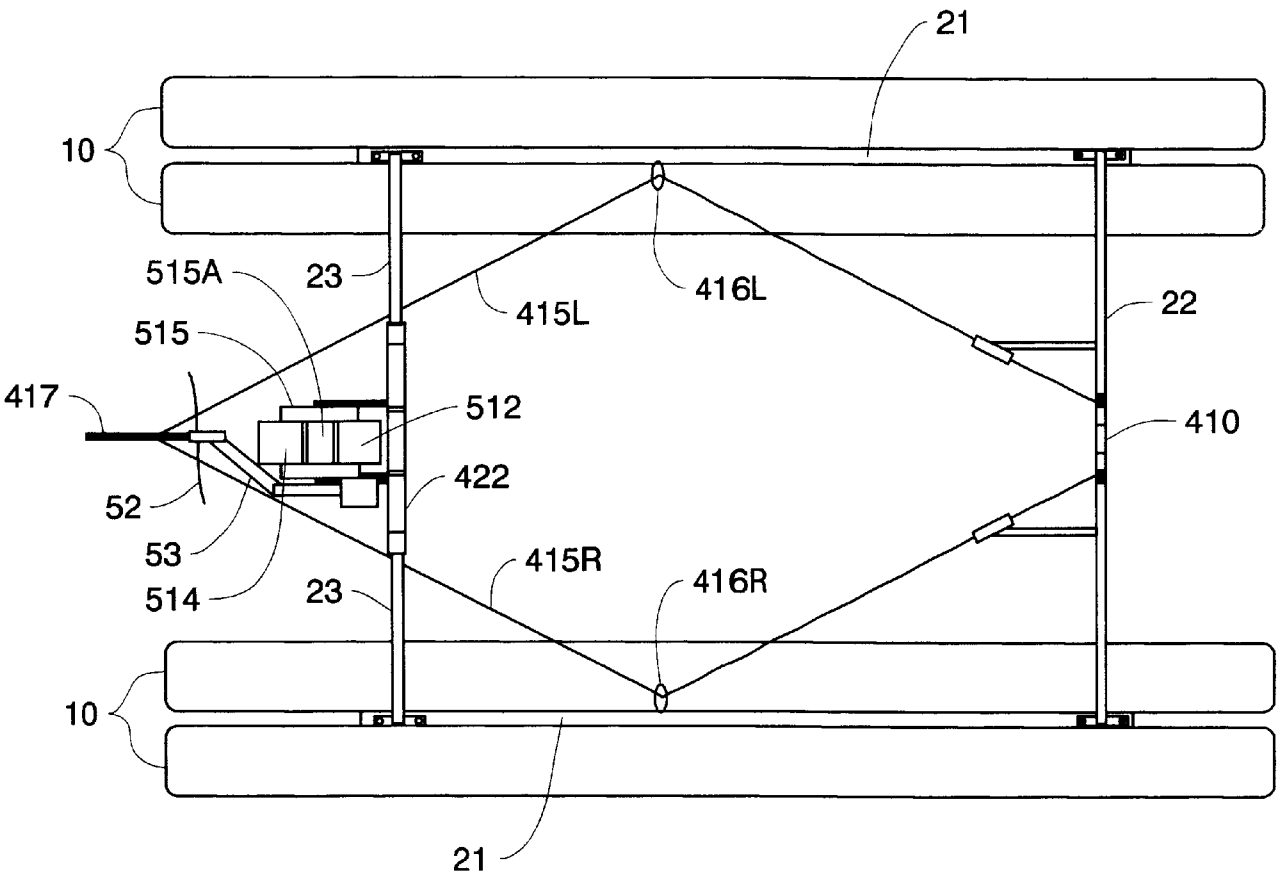
FIG. 2 depicts a top view of the present invention.
Figure 3:
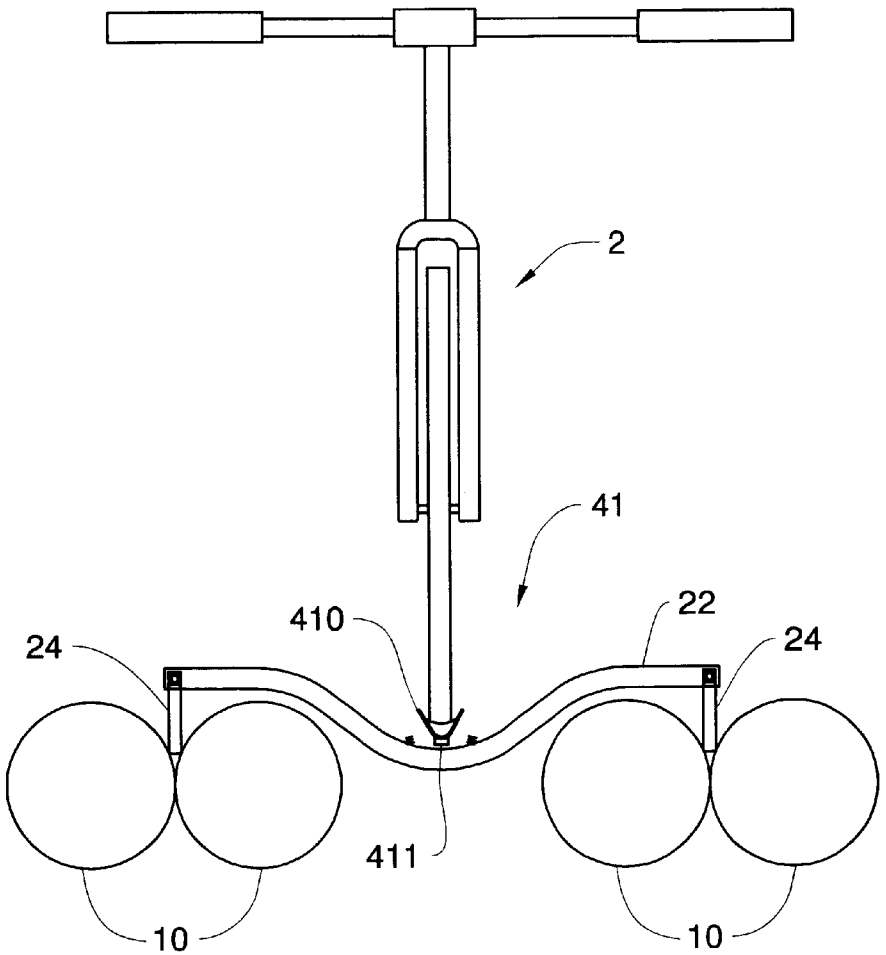
FIG. 3 depicts a front view of the present invention.

More specifically, the at least one pontoon 10 is of the type and size used on a variety of other similarly sized pontoon boats. In the present invention, the at least one pontoon 10 must be a structure with buoyancy properties sufficient to keep the watercraft 1, the bicycle 2, and a rider afloat. Accordingly, designing the at least one pontoon 10 to keep the watercraft 1 afloat is considered within the knowledge of one ordinarily skilled in the art. Inflatable pontoons 10 are the preferred design, however is the preferred material of construction, however other materials such as hard plastic wood, metal could also be used. The preferred embodiment of the watercraft 1 uses four inflatable pontoons 10, a pair on either side of the mounted bicycle 2, and laterally displaced at a distance sufficient to provide substantial stability to the watercraft 1. See FIG. 2. A pump that is removably attachable to said fame 20, or mounting hardware, 41 and 42, inflates the pontoons 10.

Figure 4:
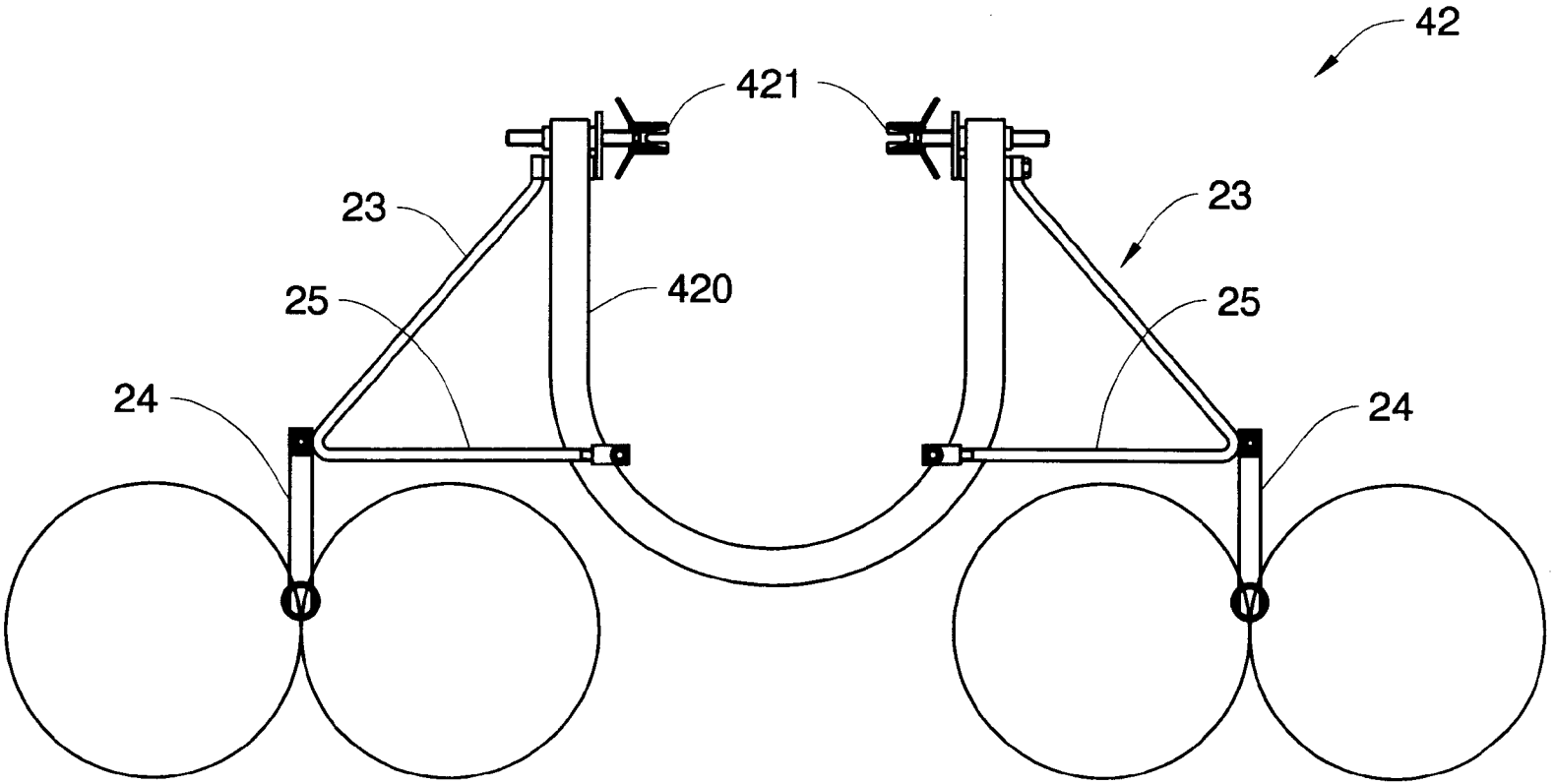
FIG. 4 depicts a back view of the present invention.

The frame 20 of the watercraft 1 provides the underlying structure for the other main components of the watercraft 1. The frame 20 design is preferably lightweight, sturdy and constructed from plastic tubing, however, other materials such as metal and wood can also be used. In the preferred watercraft 1, the Came 20 comprises two longitudinal pontoon rods 21, a curvilinear front transverse support 22, and two rear transverse supports 23. Each of the longitudinal pontoon rods 21 is positioned between, and coupled to, each of the pairs of the pontoons 10. Moreover, both longitudinal pontoon rods 21, the curvilinear front transverse support 22, and the two rear transverse supports 23, are each comprised of at least two sections that can be disassembled for transport or storage of the watercraft 1. Each distal end of the front transverse support 22 is coupled to one of the longitudinal pontoon rods 21, by a connecting assembly further comprising two vertical rods 24 connected to a transverse rod 25. The two rear transverse supports 23 also couple to the longitudinal pontoon rods 21 by connecting assemblies further comprising two vertical rods 24 connected to transverse rods 25. See FIG. 4.

Coupled to the front transverse support 22 and the rear transverse supports 23 is front and rear bicycle mounting hardware, 41 and 42, respectively. The bicycle mounting hardware, 41 and 42, enables the bicycle 2 to be attachably mountable on the watercraft 1. In the preferred embodiment, the front mounting hardware 41 further comprises a front mounting base 411 and a swiveling mounting head 410. The front mounting base 411 is coupled at a medial position of the front transverse support 22, and a rotating shaft couples the swiveling mounting head 410 to said front mounting base 411. The swiveling mounting head 410 is substantially trough-shaped and adapted to receive the front tire of a bicycle 2.

The rear mounting hardware 42 secures and supports the rear weight of the bicycle 2 and the rider. In the preferred embodiment, the rear mounting hardware 42 comprises a rear axle platform 420 and rear axle attachment grooves 421. The rear axle attachment grooves 421 enable attachment of the bike 2 to the rear axle platform 420 in the manner that bicycle tires are ordinarily attached to bicycle frames. The rear axle platform 420 is coupled between the rear transverse supports 23 of the fame 20.

The steering mechanism of the watercraft enables the bicycle rider to alter the moving direction of the watercraft 1. In the preferred embodiment, the steering mechanism comprises left and right steering cables, 415L and 415R respectively, left and right steering cable guides, 416L and 416R respectively, a rudder 417 and a rudder assembly 418. A first distal end of each of said two steering cables, 415L and 415R, is each attached on one side of the swiveling mounting head 410. A second distal end of each of said two steering cables, 415L and 415R, is threaded through each respective steering cable guides, 416L and 416R, and attached on either side of the rudder 417. The rudder assembly 418 comprises a propeller guard 418A and a rudder hinge 417A. See FIG. 2.

The propulsion mechanism 50 of the present invention comprises a torque transfer mechanism 51, a propeller shaft 53, and a propeller 52. The propulsion mechanism 50 propels the watercraft 1 by translating into propeller 52 rotation the torque developed from a person pedaling the bicycle 2 mounted on the watercraft 1.

In the preferred embodiment, the torque transfer mechanism 51 comprises a support roller 514, a friction roller 512, and a transfer gear 513. The transfer mechanism 51 is attached to an adjustable roller chassis 515 that is removably attachable to two rear tire platform brackets 422 that extend rearward from the rear axle platform 420.

A support roller axle 514A and a friction roller axle 512A connect the support roller 514 and the friction roller 512 to the roller chassis 515 respectively. The roller chassis 515 is adjustably securable to the two rear tire platform brackets 422 by two securing shafts 516. Pressure adjustment hardware further comprised of a pressure screw 517, cross bracket 518, and spring biased pins 519 further enable the adjustment of the pressure between the support roller 514 and the friction roller 512 against the bicycle 2 rear tire. The roller chassis 515 is adjustable upwardly at an angle, to establish and maintain contact between the bicycle 2 rear tire and the support roller 514 and the friction roller 512. The roller chassis 515 is pivotally secured between the two securing shafts 516 by a chassis pivot axle 515A and allows the roller chassis 515 to receive and cradle the rear tire of the bicycle 2 at an angle that enables the best contact between the support roller 514 and the friction roller 512 and the bicycle 2 rear tire.

Figure 5:
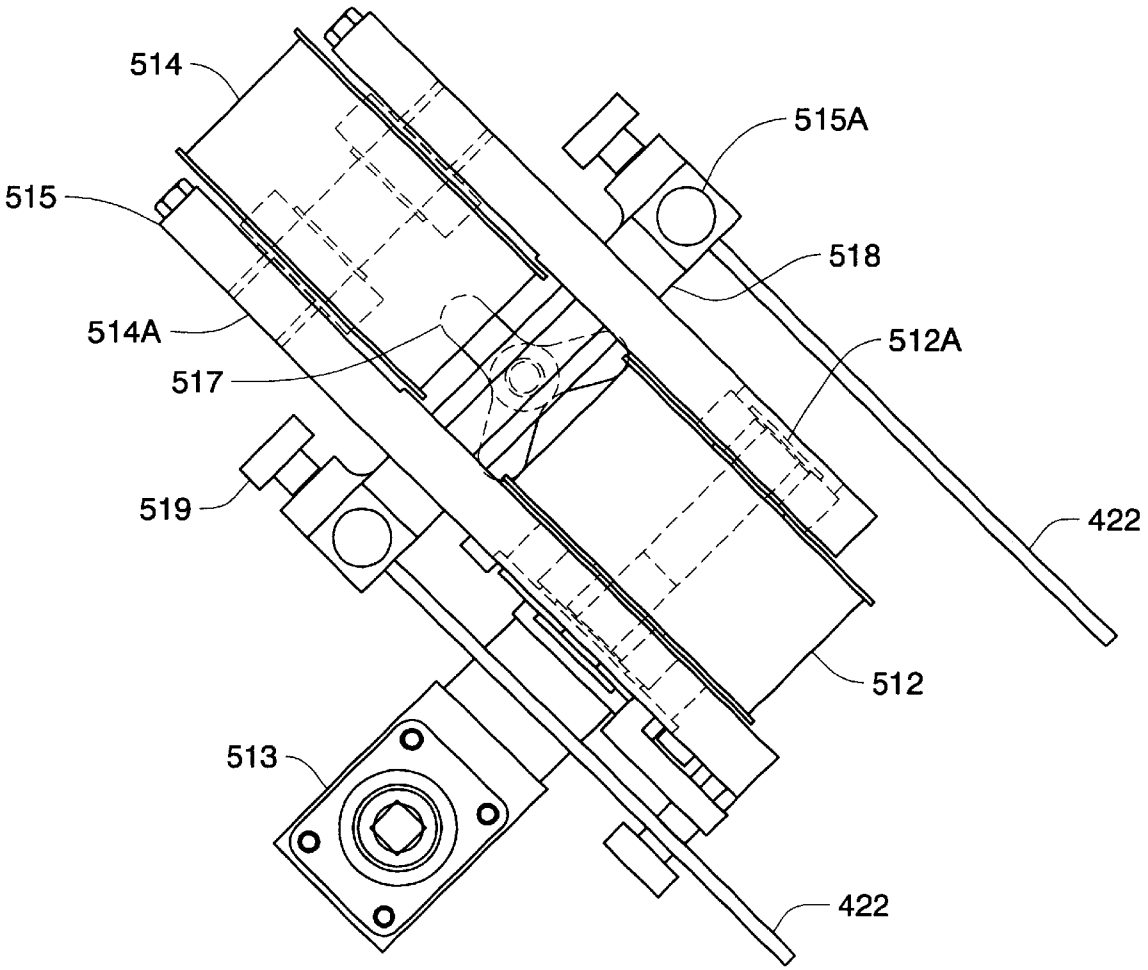
FIG. 5 depicts a top view of the propulsion mechanism.
Figure 6:
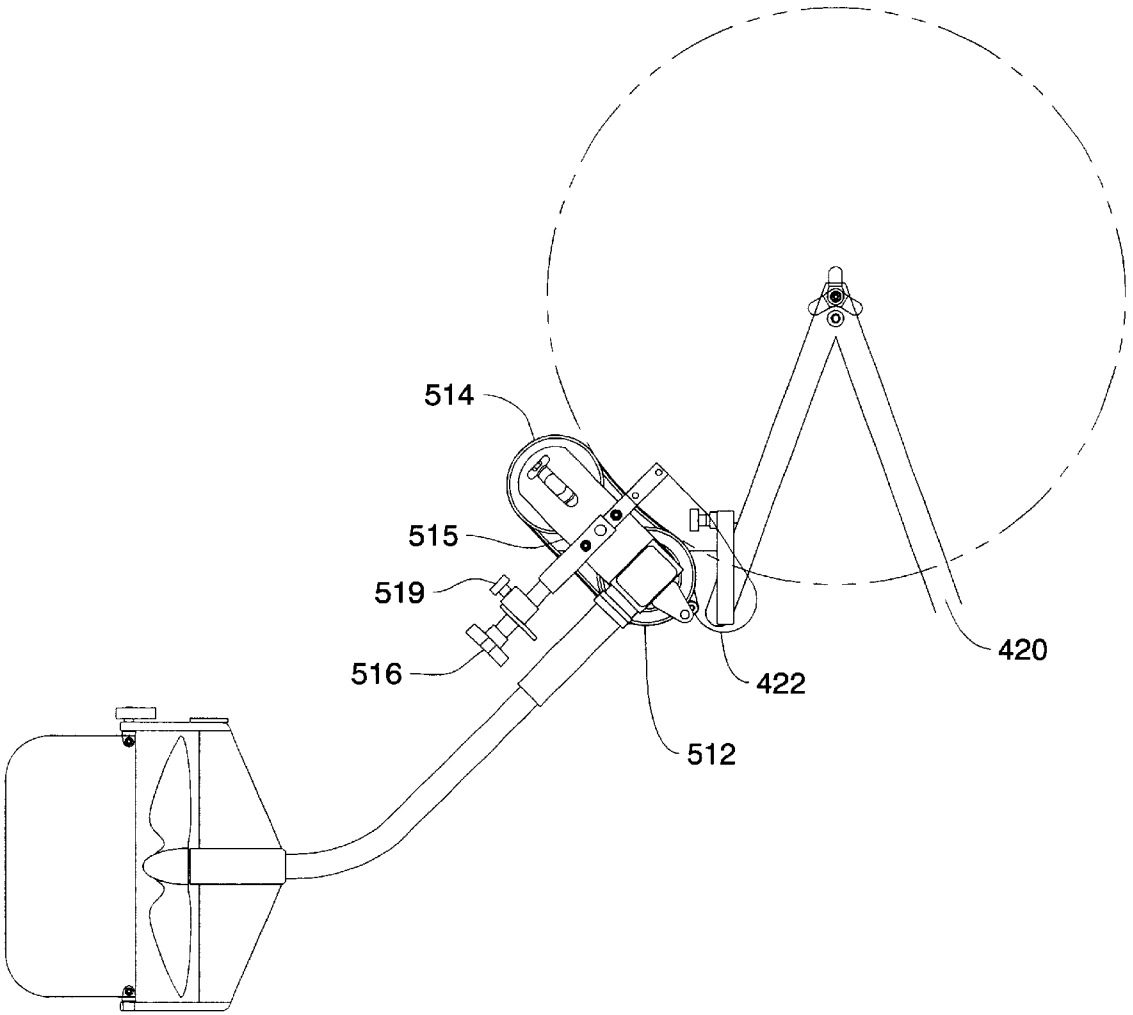
FIG. 6 depicts a side view of the propulsion mechanism.

The friction roller axle 512A rotates the transfer gear 513 in a manner that is ordinary in the art for transferring off angle torque. The transfer gear 513 connects by the propeller shaft 53 to the propeller 52. It is also preferred to create an articulable propeller shaft 531 by use of a universal joint in said shaft 53. Said articulable propeller shaft 531 enables using the watercraft 1 in a minimal amount of water since said propeller 52 may be displaced in the vertical direction to avoid damaging the propulsion mechanism 50 in the event that the rudder assembly 418 touches the bottom of the body of water. The rotating propeller 52 provides thru to the watercraft 1 in the ordinary manner. See FIG. 5.

Preferably, the bicycle 2 is equipped with saddlebags to carry the deflated pontoons 10, the unassembled frame 20, mounting hardware, 41 and 42, and propulsion mechanism 50. When the rider and bicycle 2 reach the body of water, the pontoons 10 are inflated and the remaining components of the watercraft 1 are assembled. Next, the bicycle 2 is mounted on the watercaft 1, and the rear tire of the bicycle 2 wedged between the friction roller 512 and the support roller 514. When the bicycle 2 is peddled, the friction between the rubber tire of the bicycle 2 and the friction roller 512 transfers the tire rotation into friction roller 512 rotation and accordingly, rotational movement of the transfer gear 513, the propeller shaft 53 and the propeller 52. To direct the watercraft 1, the handlebars of the bicycle 2 are turned in the fashion that is customary to turn the bicycle 2. Accordingly, the wheel of the bicycle 2 moves from side to side and causes the mounting head 410 to swivel. Since the cables, 415L and 415R, are attached to the mounting head 410, said cables, 415L and 415R, undergo substantially longitudina movement and accordingly, direct the rudder 417 and cause the moving watercraft 1 to turn. Therefore, in the preferred design, the watercraft 1 is propelled and directed in substantially the same way a bicycle is directed on the land.

The preferred embodiment of the invention is described above in the Drawings and Description of Preferred Embodiments. While these descriptions directly describe the above embodiments, it is understood that those skilled in the art may conceive modifications and/or variations to the specific embodiments shown and described herein.

Any such modifications or variations that fall within the purview of this description are intended to be included therein as well. Unless specifically noted, it is the intention of the inventor that the words and phrases in the specification and claims be given the ordinary and accustomed meanings to those of ordinary skill in the applicable art(s). The foregoing description of a preferred embodiment and best mode of the invention known to the applicant at the time of filing the application has been presented and is intended for the purposes of illustration and description. It is not intended to be exhaustive or to limit the invention to the precise form disclosed, and many modifications and variations are possible in the light of the above teachings. The embodiment was chosen and described in order to best explain the principles of the invention and its practical application and to enable others skilled in the art to best utilize the invention in various embodiments and with various modifications as are suited to the particular use contemplated.

What is claimed is:

1. A watercraft accessory for a bicycle, comprising:

A. a frame, the frame further comprising, i. two longitudinal pontoon rods, ii. a front transverse support coupled at each distal end to one of said two longitudinal pontoon rods by first and second connecting assemblies further comprised of two vertical rods connected to a transverse rod; and iii. two rear transverse supports, a first of said two rear transverse supports coupled to a first of said two longitudinal pontoon rods by a third connecting assembly further comprised of two vertical rods connected to a transverse rod, and a second of said two rear transverse supports coupled to a second of said two longitudinal pontoon rods by a fourth connecting assembly further comprised of two vertical rods connected to a transverse rod;

B. at least one pontoon, coupled to one of the two longitudinal pontoon rods;

C. front bicycle mounting hardware coupled to the transverse rods of the first and second connecting assemblies;

D. rear bicycle mounting hardware coupled to coupled to the transverse rods of the third and fourth connecting assemblies of the frame; and E. a propulsion mechanism coupled to the two rear transverse supports;

whereby the bicycle is mountable on the watercraft and the peddling action of the bicycle drives the propulsion mechanism.

2. The watercraft in claim 1 wherein said front transverse support is a curvilinear tube.

3. The watercraft in claim 1 wherein said front mounting hardware further comprises;

A. a front mounting base attached to said front transverse support; and

B. a swiveling mounting head, attached by a rotatable shaft.

4. The watercraft in claim 3 wherein said rear mounting hardware further comprises a rear axle platform and rear axle attachment grooves.

5. The watercraft in claim 1 wherein said propulsion mechanism comprises:

A. a roller chassis comprising, i. a friction roller coupled to said roller chassis; and ii. a support roller coupled to said roller chassis;

B. a transfer gear coupled to said friction roller, and coupled to,

C. a propeller by a propeller shaft.

6. The watercraft in claim 1 further comprising a steering mechanism comprising:

A. left and right steering cables, each attached at a first distal end to said front bicycle mounting hardware and threaded through;

B. left and right steering cable guides each attached to said frame; said left and right steering cables each attached at a second distal end to;

C. a rudder.

7. The watercraft in claim 1 having two pairs of pontoons coupled to said frame with one pair on the left side of the watercraft and with the other pair positioned on the right side of the watercraft.

8. The watercraft in claim 1 wherein the at least one pontoon is constructed from the group of materials consisting of plastic, wood, or metal.

* * * * *